United States Patent [19]

Jones

[11] 3,931,657

[45] Jan. 13, 1976

[54] LIFE VEST

[75] Inventor: Walter C. Jones, Armstrong, Iowa

[73] Assignee: Rubber Dynamics Corporation, Armstrong, Iowa

[22] Filed: June 12, 1974

[21] Appl. No.: 478,740

[52] U.S. Cl. ..... 9/342
[51] Int. Cl.[2] ..... B63C 9/10; B63C 9/16
[58] Field of Search ..... 9/316, 329, 340–342

[56] References Cited

UNITED STATES PATENTS

| | | | |
|---|---|---|---|
| 1,742,104 | 12/1929 | Skoldberg | 9/342 |
| 2,629,118 | 2/1953 | Frieder et al. | 9/342 |
| 2,905,954 | 9/1959 | Lanciano, Jr. | 9/342 |
| 3,199,128 | 8/1965 | Nojd | 9/341 |
| 3,266,070 | 8/1966 | O'Link | 9/342 |

*Primary Examiner*—Trygve M. Blix
*Assistant Examiner*—Stuart M. Goldstein
*Attorney, Agent, or Firm*—Williamson, Bains & Moore

[57] ABSTRACT

A personal flotation device includes front and rear panels secured together to form an aesthetically appealing life vest. The panels are provided with relatively thin sheets of buoyant material of sufficient buoyancy to cause a user to remain afloat while in the water. The vest is provided with an inflatable bladder which may be readily inflated to increase the buoyancy of the flotation vest. The flotation vest is also provided with a collar through which the bladder extends and serves to cause the user to float face-up when the bladder is inflated.

5 Claims, 5 Drawing Figures

LIFE VEST

SUMMARY OF THE INVENTION

This invention relates to a personal flotation device and more specifically to a flotation device generally known as a life vest.

There are various types of personal flotation devices including both the inflatable and noninflatable life vests. The noninflatable prior art life vests are usually bulky, generally unattractive, and are often uncomfortable. The United States Coast Guard and other agencies urge that life vests and other personal flotation devices be worn at all times by persons in watercraft. Because the uninflatable type prior art vests are bulky, unattractive and often uncomfortable, these life vests are usually not worn, but are merely carried in the watercraft. It has also been found that it is difficult to construct these noninflatable prior art life vests so that they will properly fit small children whose body sizes and shapes vary extensively.

It is therefore an object of this invention to provide a novel life vest which is not only effective as a flotation device, but is also aesthetically appealing in appearance and comfortable to wear.

Specifically, the life vest is provided with buoyant sheets of material which impart buoyancy thereto, and is also provided with an inflatable bladder, which when inflated, increases the buoyancy of the life vest. It has also been found that when the inflatable bladder is inflated, it not only increases the buoyancy of the life vest, but also serves to cause the vest to more snuggly and comfortably fit a user and is therefore especially adapted for use with small children.

Another object of this invention is the provision in the life vest of a collar through which the inflatable bladder extends, the collar being shaped and constructed to present a fashionable and styled garment feature when the bladder is in a deflated condition, but causing the user to float face-up when the bladder is in the inflated condition.

These and other objects and advantages of this invention will more fully appear from the following description made in connection with the accompanying drawings wherein like reference characters refer to the same or similar parts throughout the several views.

FIGURES OF THE DRAWINGS

DESCRIPTION OF THE PREFERRED EMBODIMENT OF THE INVENTION

Figure 1:
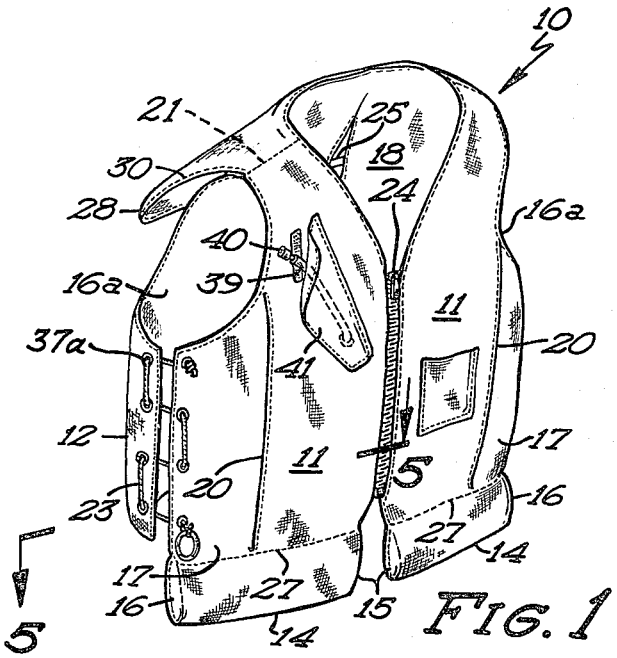
FIG. 1 is a front perspective view of the novel life vest.

Referring now to the drawings and more specifically to FIG. 1, it will be seen that one embodiment of the novel life vest, designated generally by the reference numeral 10, is there shown. The life vest 10 includes a pair of front panels 11 and a pair of back panels 12, each panel having an upper peripheral edge 13, a lower peripheral edge 14, and an inner longitudinal edge 15 and an outer longitudinal edge 16. Each panel also has an exterior surface and an interior surface, the exterior surface being defined by a fabric cover 17, preferably formed of a cotton polyester blend and which may have any suitable pattern design for aesthetic appeal. The inner surface of each panel is defined by a liner 18, also formed of a suitable fabric such as muslin or the like. The cover and liner for each panel are sewn together at their respective peripheries, and each panel has a sheet 19 of buoyant material disposed between the cover and liner thereof. The sheet 19 is preferably formed of a semi-rigid crosslinked polyethylene foam. The front cover 17 is provided with a longitudinal pleat or fold 20 which, as shown, is located between the inner and outer longitudinal edges of the front panel.

Each front panel 11 is secured at its upper edge 13 to the upper edge 13 of one of the back panels 12 by means of a stitch 21. It is pointed out that the stitch 21, as well as all of the stitching in the life vest 10 comprises a lock stitch for the purpose of safety. It will also be noted that both the front and rear panels have longitudinally spaced apart grommets 22 therein, along the respective outer longitudinal edges thereof. Each front panel 11 is secured to one of the back panels 12 at its outer longitudinal edge by means of a cord 23 which is laced through the grommets in the front and back panels. The inner longitudinal edges of the front panels 11 are provided with a zipper-type closure fastener 24 which permits opening and closing of the vest by a user. It is pointed out that the zipper closure fastener is preferably formed of a noncorrosive material such as plastic and is of the self-locking type. The back panels 12 are secured together at spaced longitudinal points adjacent their inner longitudinal edges by means of connecting fabric strips 25.

Each front panel 11 is provided with a small block 26 of buoyant material which is interposed between the cover 17 and liner 18 of the associated panel. The block 26 is separated from the associated sheet 19 by means of a stitch 27, and is in effect, hinged relative to the sheet 19. The block 26 is also formed of a foamed polyethylene and it will be noted that it is substantially smaller in area than the single elongate sheet 19 for each panel. By using a single, relatively thin sheet 19, the bulky unappealing appearance which characterizes most prior art life vests is avoided. It will further be noted that each front panel and back panel 12 are not connected along their entire outer longitudinal edges, so that arm holes 16a are defined therebetween.

The vest 10 is also provided with a collar 28 which is comprised of a pair of substantially identical sheets 29 of fabric, preferably of the same fabric from which the cover 17 of each panel is formed. The sheets 29 of the collar 28 are secured together along three of their peripheral edges by a stitch 30 while the remaining transverse peripheral edge of the lowermost sheet 29 is secured by stitching 31 to the back panels 12, and the remaining transverse peripheral edge of the uppermost sheet 29 is secured by the stitching 31 to the front panels 11.

The life vest 10 also includes a generally inverted, elongate, U-shaped inflatable bladder 32 which is comprised of a pair of spaced apart elongate sections 33 which are interconnected at their respective ends by a bight portion 34. Each of the elongate sections 33 is of reduced transverse size adjacent the bight portion 34 to thereby define a neck **33*a* thereat. Each of the elongate sections 33 is interposed between the sheet 19 and the cover 17 of one of the front panels 11 and extends from adjacent the stitch 27 upwardly with the bight portion thereof extending through the collar 28.**

Figure 4:
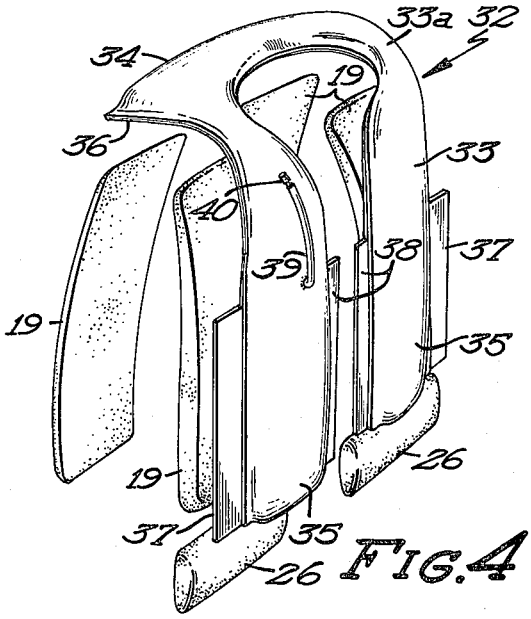
FIG. 4 is an exploded perspective view illustrating certain components of the novel life vest.
Figure 2:
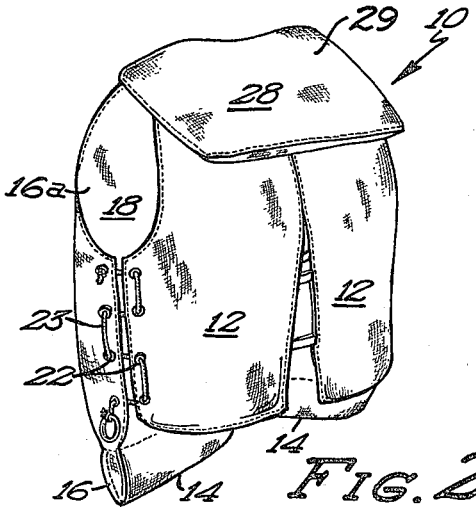
FIG. 2 is a rear perspective view thereof.
Figure 3:
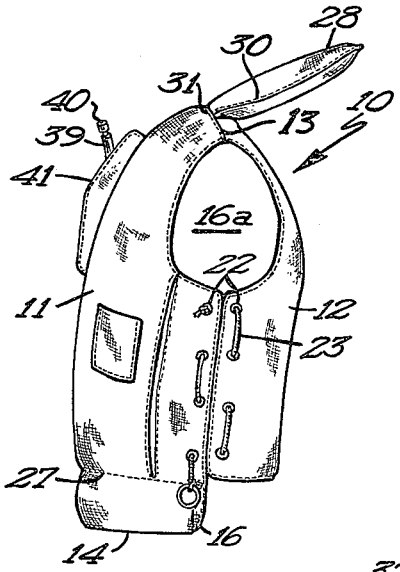
FIG. 3 is a side elevational view thereof.
Figure 5:
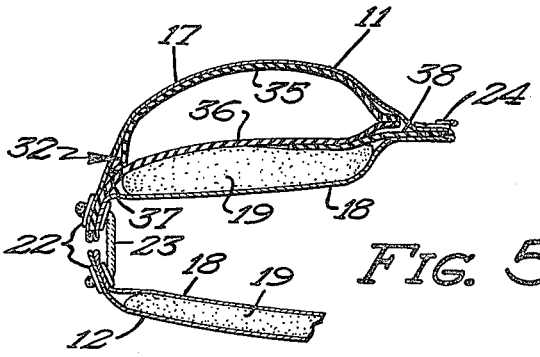
FIG. 5 is a cross-sectional view taken approximately along line 5–5 of FIG. 1, and looking in the direction of the arrows, but with the inflatable bladder being illustrated in an inflated condition.

Referring now to FIGS. 4 and 5, it will be seen that the bladder 32 is actually comprised of an upper sheet 35 and a lower sheet 36, each being shaped to the configuration of the bladder. The sheets are secured together at their respective peripheral edges in sealing relation by a suitable adhesive. That portion of the lower sheet 36 which defines each elongate section 33 has a lateral extension 37 provided with openings 37*a* therein through which the grommets 22 project. Each elongate section 33 is also provided with an attachment strip 38 which is secured to the lower sheet 36 and which projects laterally inwardly from each elongate section 33. These attachment strips 38 for each elongate section are secured to the associated zipper closure fastener structure. It will therefore be seen that each of the elongate sections 33 of the bladder are permanently anchored along its perspective longitudinal edges to some portion of the associated front panel.

The bladder 32 is provided with an elongate flexible conduit 39, an adjustable valve 40 adjacent its outer end, the outer end defining an outlet or mouthpiece. The valve 40 is of conventional construction and is spring urged to a closed position but may be urged longitudinally of the conduit to an open condition when it is desirable to inflate or deflate the bladder. The conduit 39 is positioned below a flap 41 which is stitched to the cover 17 of the associated front panel and which is held in a closed position by a suitable velcroe-type fastening means. The flap 41 may be formed of the same material from which the cover 17 is formed.

The life vest 10 is aesthetically more appealing than conventional prior art life vests since it presents a less bulky appearance and, when worn in a deflated condition, is quite similar to a conventional garment-type vest. This is accomplished through the use of single elongate sheets of buoyant material for each panel, each have a thickness dimension substantially less than the thickness dimension of the large blocks used in prior art life vests. In this respect, it is pointed out that the thickness dimension of the buoyant sheets 19 for the rear panels is less than the thickness dimension of the buoyant panels for the front panels.

The inflatable bladder 32 is also substantially smaller in all dimensions than the bladders used in prior art inflatable life vests. Thus when the bladder is in the deflated condition, it adds very little by way of bulk to the front panels and to the collar. Therefore, when the bladder is in the deflated condition, the collar has a low flat profile and lies upon the back panels in substantially the same manner as a collar for a garment.

The sheets 19 are of a sufficient buoyancy so as to cause a user to remain afloat in the water even though the life vest is in a deflated condition. As a matter of fact, the sheets 19 of buoyant material have a buoyancy of 15.6 pounds which meet the Coast Guard requirements for buoyancy for a noninflatable type personal flotation device. However, in the event that a user concludes that he may be in the water for an extended period of time, the user may then inflate the bladder 32 which not only imparts additional buoyancy to the vest, but the collar 28 when inflated, avoids the negative riding moment resulting from a person afloat and thereby causes the user to float face-up.

When the life vest 10 is worn by a child, and it is found that the life vest does not properly and comfortably fit the child, the bladder 32 may then partially or completely be inflated to very snuggly fit the torso of the child. The capability of the life vest 10 to conform to a child's torso cannot be accomplished with prior art life vest devices. The bladder 32 may also be partially or fully inflated by a user to cause the vest to fit more snuggly, especially the collar 28 for the purpose of increasing the comfort of the life vest for protection against moisture and cold. The use of the pleats 20 also not only impart a stylized feature to the garment, but permit the bladder to expand outwardly away from the body of the user, rather than inwardly which permits the life vest to be inflated without a decrease in the comfort of the vest.

Thus it will be seen that I have provided a life vest which is not only of novel and inexpensive construction, but one which functions in a more efficient manner than any heretofore known comparable flotation devices.

What is claimed is:

1. A personal flotation vest device comprising:

a pair of front panels and a pair of rear panels, each panel having inner and outer longitudinal edges, upper and lower edges, means securing the respective upper edges and portions of the outer longitudinal edges of a front panel and back panel together to define an armhole therebetween, means securing the inner longitudinal edges of the back panels together, and releasable closure means for releasably securing the inner longitudinal edges of the front panels together, each panel including a flexible fabric liner covering the interior surface thereof and a flexible cover covering the exterior surface thereof and secured at its periphery to the periphery of the associated fabric liner, each panel including a vertically extending sheet of buoyant material extending from adjacent the lower edge of each panel to a point adjacent the upper edge thereof and interposed between the associated liner and cover, a collar secured to said panels and including a pair of sheets of flexible fabric secured together at peripheral portions thereof, a generally U-shaped inflatable bladder formed of an elastic gas impervious material and including a pair of elongate sections and a bight portion extending between such sections said bight portion of the bladder being positioned between the sheets of said collar, each elongate section of said bladder having means thereon adjacent one longitudinal edge portion thereof attached to said closure means, and each section having means thereon adjacent its other longitudinal edge portion secured to said cover and liner.

2. The vest device as defined in claim 1 wherein the cover of each front panel is provided with a longitudinal pleat to permit outward expansion of the cover when the bladder is inflated.

3. The vest device as defined in claim 1 wherein said collar including the bight portion of the bladder therein is adapted to lay in a flattened condition upon the back panels when said bladder is in the deflated condition.

4. The vest device as defined in claim 1 wherein said closure means comprises a zipper closure fastener.

5. The vest device as defined in claim 4 wherein the means on said one longitudinal edge of each elongate bladder section comprises an attachment strip to which is connected said closure means, and the means on said other longitudinal edge of each bladder section comprises a lateral extension which is attached to said cover and liner of the associated front panel.

* * * * *